United States Patent [19]

Stoppazzini

[11] Patent Number: 4,852,369

[45] Date of Patent: Aug. 1, 1989

[54] DEVICE FOR MOUNTING AND CONTROLLING THE SWITCH RETAINING AND PRESSING MEANS IN AUTOMATIC FLAT KNITTING MACHINES

[75] Inventor: Benito Stoppazzini, Sala Bolognese, Italy

[73] Assignee: E.M.M., S.R.L., Padulle Di Sala Bolognese (Bologna), Italy

[21] Appl. No.: 215,650

[22] Filed: Jul. 6, 1988

[30] Foreign Application Priority Data

Oct. 2, 1987 [IT] Italy ..... 4961/87[U]

[51] Int. Cl.[4] ..... D04B 7/04

[52] U.S. Cl. ..... 66/64

[58] Field of Search ..... 66/64 H, 64 R

[56] References Cited

U.S. PATENT DOCUMENTS 4,442,683 4/1984 Shima et al. ..... 66/64 R
4,463,577 8/1984 Schimko et al. ..... 66/64 R
4,501,132 2/1985 Flavell et al. ..... 66/64 R
4,516,411 5/1985 Hampson ..... 66/64 R

FOREIGN PATENT DOCUMENTS 0112125 6/1984 European Pat. Off. .
3120554 12/1982 Fed. Rep. of Germany .
382361 11/1964 Switzerland .

*Primary Examiner*—Ronald Feldbaum
*Attorney, Agent, or Firm*—Darby & Darby

[57] ABSTRACT

The device comprises a box-shaped element, mounted to a carriage of a flat knitting machine, a plate located above the needle bed of the machine being an integral part of this element.

The plate features vertical grooves on one of its sides, within which pins are housed so that they are able to slide along their axes, subject to the action of rockers, which are hinged to the plate and operated by a rod with rack section, located above the plate and moved along their axes in order to raise or respectively lower pins, to the lower ends of which stitch retaining-pressing means are fitted.

2 Claims, 1 Drawing Sheet

Fig.1
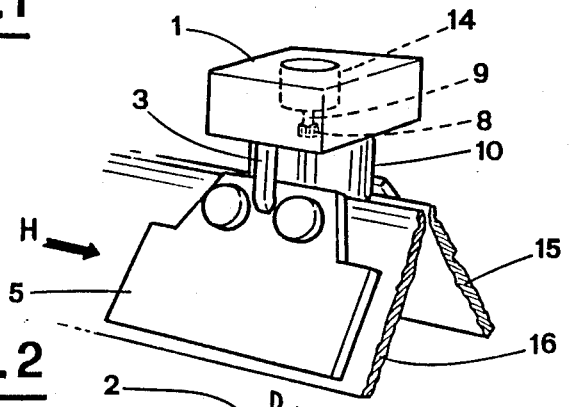
Fig.2
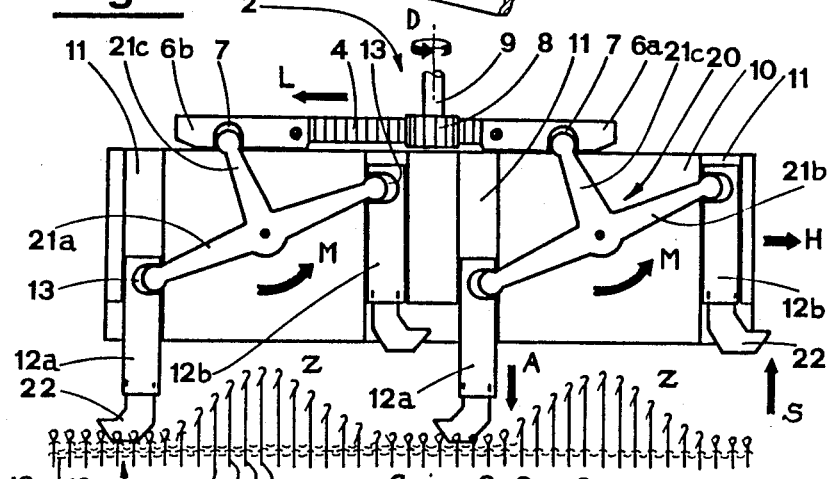
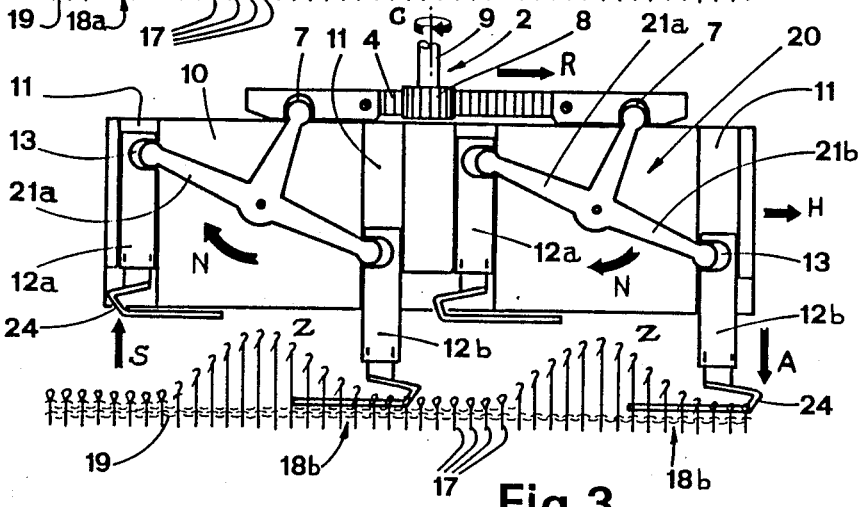
Fig.3

DEVICE FOR MOUNTING AND CONTROLLING THE SWITCH RETAINING AND PRESSING MEANS IN AUTOMATIC FLAT KNITTING MACHINES

BACKGROUND OF THE INVENTION

The invention relates to a device for mounting and controlling the stitch retaining and pressing means in automatic flat knitting machines.

DESCRIPTION OF THE PRIOR ART

It is known that the needle beds of automatic flat knitting machines, above which a carriage moves with an outwards and return movement, feature equidistant slots that are perpendicular to the direction of travel of the carriage.

The function of the carriage is to send needles located in the slots into operation in succession, as described below.

Sending the needles into operation mainly consists in raising them, or sliding them within their relates slots until they project for a certain length above the needle beds, and then subsequently lowering them in order to form knitting stitches making a row of knitted fabric.

The needles are sent into operation through various means working in conjunction with one another, such as, for example, sinkers located in the same slots, and series of cams located on the inside walls of the carriage.

The needles are raised in succession, in small groups of needles, corresponding to one or more areas known as work zones, dynamically situated below the carriage.

The technologically most advanced machines indeed feature several groups of cams, also known as operating groups, on the carriage and thus also have several work zones, consequently forming several rows of knitting.

Optimum stitch formation is obtained when, following the above operations, the last row of the fabric is not drawn upwards as a consequence of the needles having been raised. It is in the same way necessary to exert a downwards pressure on a small portion of the last row formed, situated immediately downstream of each work zone, which is to say immediately downstream of the zone occupied by the needles during their return to what is known as their idle position.

DE. OS No. 3336781 (TEXTIMA) described a device comprising a bent-over rod that is an integral part of the carriage, positioned in correspondence with the longitudinal heads of the needle beds, and parallel to the latter, in the zone where the needles are lifted, and practically in contact with the last row of fabric, holding the latter downwards.

The rod, below the portions of the needles projecting from the needle beds, prevents the fabric from moving upwards as a consequence of the raising of the needles.

This rod, like other means with a similar shape and functional characteristics, is known to technicians in the sector as a "stitch retainer" or "holding-down means".

The device described in DE. OS No. 3336781, also includes a disc, mounted on the carriage, located immediately downstream of the needles' work zone and oriented parallel to the direction in which the carriage moves, such that it pushes downwards on part of the last row to have been formed.

This disc, and other devices shaped and operating in a similar way, are generally referred to as "stitch pressers" by technicians in the sector.

The abovementioned solutions, like the majority of similar solutions known until today, are only able to function in one direction, as is the case with circular knitting machine or flat knitting machines with two parallel pairs of needle beds connected in a ring, and in which the carriage, or carriages, operate periodically and alternately on one and then on the other pair of needle beds.

This is due to the fact that the stitch retaining-pressing means are fitted to the carriage in a fixed position, and are thus able to operate in only one direction.

Carriages operating in both directions require two sets of stitch retaining-pressing means, positioned upstream and downstream of the needles' work zone respectively.

The stitch retaining-pressing means are subjected to the action of complicated and costly devices that lower (activate) them to a mechanically defined fixed position, or raise (de-activate) them in relation to the direction of movement of the carriage.

It is obvious that, due to the fixed mounting, in the case previously described, or the fixed position, in the operative stage, of the stitch retaining-pressing means, the force with which the latter operate on the fabric cannot undergo even the smallest adjustment, if not at the initial stage when the entire device is being mounted.

There are only a limited number of possibilities for subsequent adjustment, difficult to perform, of the pressure exerted on the fabric in relation to the results obtained.

E.P.C. No. 86830241.5, submitted in the name of the same applicant, describes a device comprising rods located beneath the needle beds, perpendicularly orientated in relation to the carriage's direction of movement, able to be raised or lowered by corresponding cams located on the carriage, such that their ends are inserted between the last rows of stitches formed, in the zone corresponding to the zone in which the needles are raised, retaining the knitted fabric.

The device described in this latter patent application also comprises plates that are positioned upstream and downstream of the needles' work zone.

SUMMARY OF THE INVENTION

The purpose of these plates is to press the fabric downwards (stitch presser) both before and after the work zone.

The objective of the present invention is to produce a device able to mount the stitch retaining-pressing means on the carriage of an automatic flat knitting machine, activating one part of them and de-activating the others, and vice versa, according to the direction of movement of the carriage.

The proposed device must be able to operate with both stitch-retaining and stitch-pressing means, enabling the two to be interchanged rapidly and with ease.

The final object of the present invention is to produce a device enabling one to control the pressure with which the stitch retaining-pressing means act on the fabric, achieving all the above with a solution that is nevertheless both simple and economic to produce.

The abovementioned objects are achieved by means of device for mounting and controlling the stitch-retaining means and stitch-pressing means, the latter being designed to press on corresponding portions of the knitted fabric being formed on an automatic flat knitting machine, the said portions being dynamically located in proximity to at least one of the work zones of the needles of the said machine, with the latter comprising at least one needle bed above which a carriage moves with an outwards and return motion, to send the aforementioned needles into operation, and with the latter being housed in the abovementioned needle bed; the said device being characterised by the fact that it comprises: a box-shaped element that is fixed so that it is able to be moved to the abovementioned carriage; a plate that is an integral part of the aforesaid element and lies in the vertical plane above the aforementioned needle bed, at least one of the sides of this element featuring at least two vertical grooves in each work zone, that lie on either side of the latter in relation to the direction of movement of the said carriage, and within which an equal number of pins are located respectively, it being possible for the latter to slide vertically along their axes in opposite directions, raised and lowered respectively; a rocker for each pair of pins, that is hinged to the said plate and features two arms whose free ends act on the said pins respectively, and also featuring a third arm that is subjected to the action of drive means designed to swing the said rockers in opposite directions lying in a plane parallel to the said plate, causing, respectively, the said even pins to be moved in the said raised direction, whilst the aforesaid odd pins are simultaneously moved in the lowered direction, and vice versa; the said stitch retaining-pressing means being mounted so that they are able to be moved to the lower ends of the said pins.

BRIEF DESCRIPTION OF THE INVENTION

The characteristics of the invention not to have emerged from that stated above are emphasised hereinafter with specific reference to the attached tables of drawings, in which:

FIG. 1 shows a diagrammatic view in perspective of the device which is the object of the present invention, fitted to a carriage of a flat knitting machine.

FIGS. 2 and 3 are diagrammatic illustrations of the device in two operating positions, that of the stitch retainer and stitch presser respectively.

DESCRIPTION OF THE PREFERRED EMBODIMENT

With reference to the said figures, 15 and 16 show the needle beds of an automatic flat knitting machine, supported, in known manner, by a frame, not illustrated.

A carriage 5, illustrated diagrammatically in that it is of known type, moves above the needle beds and parallel to them with an outwards and return movement.

The accompanying figures have been drawn assuming that the carriage always moves in direction H, but it is to be understood that the device functions equally with the carriage moving in the opposite direction.

The design includes an electronic control unit (not illustrated in that of known type) which controls the activation and de-activation of the operating units fitted to the carriage for sending the needles into operation, following the instructions in a knitting program.

The needle beds 15 and 16 feature, as is known, equidistant slots (not shown in detail in the figure) within which the needles 17 are located.

The needles 17 are raised (sent into operation) and lowered (returned to the idle position) following a known technique, using further means (not illustrated) such as, for example, sinkers, also located inside the slots, and cams fitted to the carriage 5.

The needles 17 are sent into operation, in succession, in one or more zones Z, dynamically situated beneath the carriage 5 at each passing of the latter.

The example illustrated in FIGS. 2 and 3 features two work zones Z of the needles 17, which are sent into operation by an equal number of operating units located on the carriage.

A box-shaped element 1 is mounted above the carriage 5 by, for example, two mounting pins 3.

A plate 10, an integral part of element 1, lies vertically above the needle beds 15 and 16, in a position that is symmetrical to them One side of the plate 10 features a series of grooves 11, laid out in pairs, with the grooves of each pair being located on either side of the operating units, and thus also of the respective work zones Z.

The grooves 11 have the function of housing and guiding an equal number of pins **12*a* and 12*b*** such that the latter are able to slide vertically along their axes in opposite directions A and S, being lowered and raised respectively.

Pins **12*a* and 12*b*** each make up a pair related to each zone Z, and are in a mutual relationship as described below.

Each pair of pins features a rocker 20 which is hinged at its mid point, to the plate 10, in a central position in relation to the pins themselves, such that it is able to swing in opposite directions M and N, lying in a plane parallel to plate 10.

The free ends of two arms **21*a* and 21*b* of each rocker 20 are inserted in corresponding seats 13 formed in pins 12*a* and 12*b*** respectively.

A third arm **21*c*, located in an upwards position on each rocker, engages with drive means 2**.

Since there are two zones Z and thus two pairs of pins **12*a* and 12*b* i the example illustrated in FIGS. 2 and 3, there are also, therefore, two rockers 20 with two arms 21*c***.

The drive means 2 comprise a rod 4 with rack section that is located above the plate 10 and parallel to it, and which is able to be moved along its axis in opposite directions L and R, engaging with a pinion 8 connected to a motor 14 by means of a shaft 9, and featuring two end pieces, **6*a* and 6*b***, fitted to its end.

The two end pieces **6*a* and 6*b* feature seat 7 which are designed to receive the free ends of the abovementioned arms 21*c***.

The motor 14, of the step-by-step type, is housed inside the box-shaped element L, from which the shaft 9 protrudes.

The rotation of the shaft 9, and thus of the pinion 8, caused by the motor 14 moving in direction D (see FIG. 2), makes the rack move in direction L, parallel to the plate.

The latter causes the rocker 20 to swing in the same way in direction M, consequently lowering the odd pins **12*a* in direction A, and at the same time raising the even pins 12*b*** in direction S.

The rotation of the shaft 9, and thus of the pinion 8, caused by the motor 14 moving in direction C, opposite to the previous direction of rotation, obviously has the reverse effect, in other words causing the rack 4 to move in direction R, and the rocker 20 to swing in the same way in direction N, raising the odd pins **12*a* in direction S and at the same time lowering the even pins 12***b* in direction A.

Stitch-retaining means 24 or stitch-pressing means 22, which can be interchanged according to the requirements of the type of knitting being produced, are fitted so that they are able to be moved, following a known procedure, to the lower ends of pins 12*a* and 12*b*.

Thus, in FIG. 2, showing the stitch-pressing means 22, which is to say those designed to press the fabric 19 downwards at portions 18*a* situated immediately downstream of zones Z, the (odd) pins 12*a*, being precisely downstream of the said zones Z, are lowered, activating their related stitch pressers.

During the return movement stage of the carriage 5, not illustrated, the situation is obviously the reverse, in that it is the (even) pins 12*b* which are situated downstream of zones Z and which must thus be lowered, this being obtained by rotating the shaft 9 in direction C.

In FIG. 3, showing the stitch-retaining means 24, that must operate in the initial portion of zone Z, which is to say upon portions 18*b* of the fabric located immediately upstream of the same zones Z, the (even) pins 12*b*, situated upstream of zone Z, are lowered.

The situation is reversed during the return stroke of the carriage in this case too.

The use of a step-by-step motor makes it possible to adjust the pressure on the pins and thus on the fabric with a good degree of accuracy, although it is not infinitely variable.

The above device enables one to use stitch retaining-pressing means (which can be quickly and easily changed over, substituting the first with the second) on carriages moving in opposite directions.

A considerable advantage of the invention is the possibility of electronically controlling the raising and lowering of the pins 12*a* and 12*b*, in order to activate the stitch retaining and pressing means respectively upstream and downstream of zones Z, by means of signals sent to the motor 14 by the electronic control unit following corresponding instructions contained as required within the knitting programme.

Instructions in this programme can also be used to control the pressure of the stitch-retaining and pressing means on the fabric, due to the possibility of controlling the step-by-step motor.

Furthermore, and this is an advantage which must be emphasised, the value of this pressure can be discontinuous, thus giving rise, only on those machines using stitch-pressing means, to an effective hammering action on the fabric, which is excellent for certain special types of knitting.

Finally, the device described above is both simple and economic to produce, with obviog rise, only on those machines using stitch-pressing means, to an effective hammering action on the fabric, which is excellent for certain special types of knitting.

Finally, the device described above is both simple and economic to produce, with obvious positive effects on the overall cost of the knitting machine.

What is claimed is:

1. A device for mounting an controlling stitch-retaining means and stitch-pressing means, with said means being designed to press on corresponding potions of knitted fabric being formed on an automatic flat knitting machine, with said portions being dynamically located in proximity to at least one work zones of needles of said machine, with said machine comprising at least one needle bed above which a carriage moves with an outwards and return motion, to send said needles into operation, and with said needles being housed in said needle bed; said device comprising: a box-shaped element that is fixed such that it is able to be moved with said carriage; a plate that is an integral part of said element and lies in a vertical place above said needle bed, at least one side of said element featuring at least two vertical grooves in each work zone, that lie on either side of said work zone in relation to the direction of movement of said work zone in relation to the direction of movement of said carriage, and within which an equal number of pins are located respectively, each pin being numbered consecutively to provide even numbered pins and odd numbered pins, said even and odd pins being slidable vertically along their axes in opposite directions, raised and lowered, respectively; a rocker for each pair of pins, that is hinged to said plate and features two arms whose free ends act on said pins respectively, and also featuring a third arm that is subjected to the action of drive means designed to swing said rockers in opposite directions lying in a plane parallel to said plate, causing, respectively, said even pins to be moved in said raised direction, whilst said odd pins are simultaneously moved in said lowered direction, and vice versa; said stitch retaining-pressing means being mounted to a lower ends of said pins respectively, in such a way that they are able to be moved.

2. A device as in claim 1, wherein said drive means comprise: a rod with rack section that is able to move above said plate in opposite directions parallel to the development of said plate; a pinion which engages with said rack in order to move said rod, said pinion being made to rotate in opposite directions by a shaft connected to a step-by-step motor mounted to said box-shaped element; an end piece for each rocker fitted to said rod, each end piece featuring a seat within which a free end of said third arm of said rocker is inserted.

* * * * *